United States Patent [19]

Lee

[11] Patent Number: 4,646,658

[45] Date of Patent: Mar. 3, 1987

[54] EXTENDABLE SHELF FOR A DISPLAY RACK

[75] Inventor: Vernon E. Lee, Bedford, Tex.

[73] Assignee: Frito-Lay, Inc., Dallas, Tex.

[21] Appl. No.: 383,614

[22] Filed: Jun. 1, 1982

[51] Int. Cl.[4] ..... A47B 11/00

[52] U.S. Cl. ..... 108/143; 108/62; 108/137; 211/184

[58] Field of Search ..... 211/150, 151, 153, 132, 211/182, 184; 108/102, 143, 134, 137; 248/241, 243; 312/197

[56] References Cited

U.S. PATENT DOCUMENTS

| | | | |
|---|---|---|---|
| 793,364 | 6/1905 | Fisher | 211/184 X |
| 827,050 | 7/1906 | Weston . | |
| 1,639,387 | 8/1927 | Seward | 108/102 X |
| 1,702,937 | 2/1929 | Friedmann | 248/243 |
| 1,768,190 | 7/1930 | Rush | 211/132 X |
| 1,940,877 | 12/1933 | Ochse | 211/135 |
| 2,103,885 | 12/1937 | Whalen | 211/143 |
| 2,251,638 | 8/1941 | Sanford | 248/241 |
| 2,319,470 | 5/1943 | Nobles | 211/153 |
| 2,509,546 | 5/1950 | Welk et al. | 108/62 X |
| 2,517,284 | 8/1950 | Calvert | 211/153 |
| 2,542,872 | 2/1951 | Kanter et al. | 248/241 |
| 2,685,372 | 8/1954 | Palaith | 211/153 |
| 2,717,816 | 9/1955 | Turner | 108/143 X |
| 2,769,551 | 11/1956 | Just | 211/49 |
| 2,932,408 | 4/1960 | Jacobson | 211/134 |
| 2,937,765 | 5/1960 | Shank | 211/143 |
| 2,980,483 | 4/1961 | Davis | 312/197 |
| 3,221,677 | 12/1965 | Kerr | 108/102 |
| 3,242,885 | 3/1966 | Baker et al. | 108/137 |
| 3,305,102 | 2/1967 | Saphirstein | 211/184 |
| 3,311,072 | 3/1967 | Pattison | 108/143 |
| 3,388,808 | 6/1968 | Radek | 211/132 |
| 3,403,789 | 10/1968 | La Morte et al. | 211/150 |
| 3,493,122 | 2/1970 | McKee | 211/132 X |
| 3,612,288 | 10/1971 | Lesley | 211/132 |
| 3,765,344 | 10/1973 | Ferdinand et al. | 108/108 |
| 3,794,183 | 2/1974 | Colbridge | 248/243 |
| 3,993,002 | 11/1976 | Stroh | 108/108 |
| 4,036,369 | 7/1977 | Eisenberg | 211/88 |

FOREIGN PATENT DOCUMENTS

| | | | |
|---|---|---|---|
| 592507 | 2/1960 | Canada | 248/243 |
| 51314 | 2/1919 | Sweden | 211/153 |
| 225103 | 11/1924 | United Kingdom | 248/243 |

*Primary Examiner*—James T. McCall

*Attorney, Agent, or Firm*—Bernard, Rothwell & Brown

[57] ABSTRACT

An extendable shelf for a display rack permits the shelf to be pulled out to permit stocking and product rotation and permits it to be used in different sizes. A wire shelf is formed of inhingedly connected sections with their outermost and innermost ends connected to sheet metal side supports. The side supports are also constructed in sections which are telescopically mounted so that the side supports may be pulled out or pushed in causing the sections of the wire shelving to lie flat or hinge up to provide different depths of shelf. An upstanding member contacts product on the shelf to pull the product forward when the shelf is pulled out, thus allowing restocking of fresh product at the rear of the shelf.

1 Claim, 3 Drawing Figures

EXTENDABLE SHELF FOR A DISPLAY RACK

BACKGROUND OF THE INVENTION

1. Field of the Invention

This invention relates to improvements in display rack shelving and particularly to an extendable wire shelf which may be extended from one depth to another to permit restocking or to provide different depths for the shelf.

2. Prior Art

Display racks are commonly used in supermarkets and the like to display snack items such as potato chips, corn chips and the like which must be constantly restocked for freshness. A typical display rack of the prior art is shown for example in U.S. Pat. No. 3,993,002 wherein there are wire shelves attached to sheet metal side brackets which are attached to vertical upright members to provide wire shelving.

The restocking of snack items is important to the display and merchandising of such goods. Not only must the snack items be restocked for freshness but snack availability and visibility stimulates usage as most snacks are purchased on impulse. The restocking of snack shelves on display racks is therefore quite important, but is also labor intensive and time consuming as the oldest snack items should be positioned in the front and the freshest snack items in the rear for product rotation. At present this is done manually by the restocking salesman pulling the snack items on the shelf forward by hand and restocking the new items behind them. This can be time consuming, especially for wide shelves with a large number of snack items.

There is a need in the display rack field of shelving of different depth for several purposes. For example in some seasons snack items might sell or move from the shelves faster than in other seasons, e.g. in resort areas. Additionally, it is desirable to have different depths shelves for different space requirements of permanent displays but this creates a problem of carrying a large inventory of different depth shelves.

Telescopic wire shelving as a general concept is known e.g. in the refrigerator art, see U.S. Pat. No. 2,103,885. Extendable depth or adjustable store display shelves are also broadly known, see for example U.S. Pat. Nos. 2,685,372 and 2,769,551. Telescoping trays for retractable display racks are broadly known, as in U.S. Pat. No. 3,403,789. However, there is a need in the art for a simple, inexpensive, adjustable depth wire shelf for display rack which can be adjusted to different depths of use and can be readily adapted to permit quick and efficent restocking and product rotation.

SUMMARY OF THE INVENTION

This invention provides an extendable wire shelf which can be pulled out in the manner of a drawer to permit stocking and product rotation and alternatively can be used for at least two different depths by telescoping the shelf supports and folding up a portion of the wire shelf bottom. The wire shelf bottom also carries a member to pull product forward for restocking and product rotation. The shelf construction includes side support members in multiple sections which are telescopally mounted and provide the bracket connection to a display upright. The side supports sandwich between them a wire shelf bottom which is made of hinged sections so it may fold up or fold out depending on whether the shelf is pushed in or pulled out. The sections of the shelf bottom are hingedly connected to one another at the inner and outer ends of the shelf bottom are connected to the inner and outer ends of the side support brackets. The shelf bottom includes three sections with two hinge connections to provide the folding effect while each side support bracket includes two sections which are telescopically mounted.

DESCRIPTION OF THE PREFERRED EMBODIMENT

Figure 1:
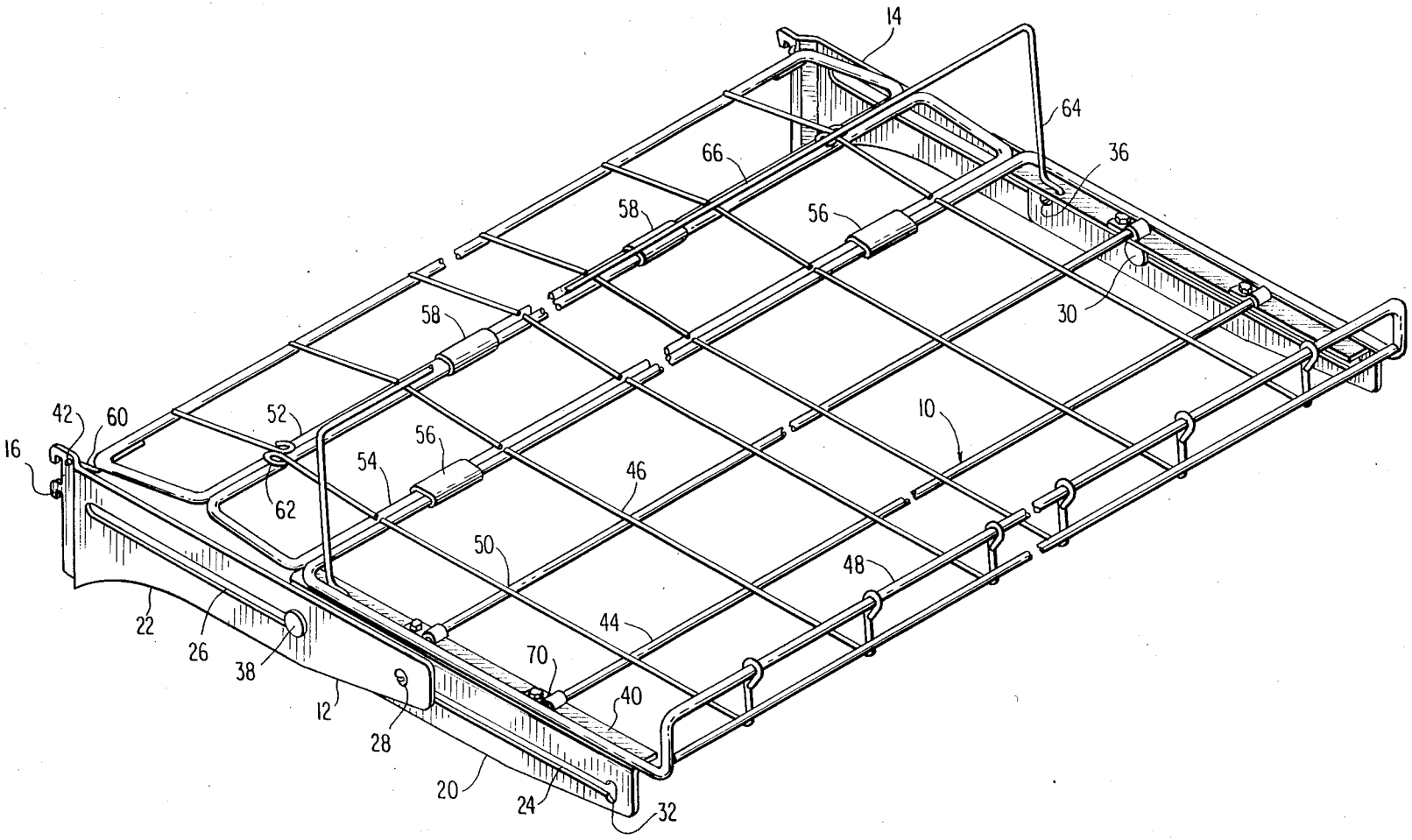
FIG. 1 is a perspective view of the extendable wire shelf of this invention.

With reference to the drawings, the extendable shelf of this invention includes a shelf bottom 10 generally extending between a pair of side support brackets 12 and 14. Each side support bracket has hooks 16 of conventional size and shape for attaching to the usual holes in uprights 18 as are commonly used in support of shelving in display racks and other areas.

Each of the side support brackets 12 and 14 are identical so only one be described. Each is formed of a pair of telescoping sections, namely outermost section 20 and innermost section 22. These sections may be conveniently formed of sheet metal as is common in the metal shelving art. Each section has a slot for allowing the sliding telescoping movement. This includes slot 24 in section 20 and slot 26 in section 22. A screw 28 mounts a post with an inner flange 30 on the front end of the rear most bracket 12 for sliding in slot 24. Slot 24 conveniently has widened portions such as portion 32 at its forward end for holding the telescoping shelves in one or the other adjusted positions. There is a similar widening slot 34 at the other end of slot 24.

Similarly, the rear end of the front bracket 20 carries a screw slide post 36 which has a enlarged end 38 to guide it in slot 26. The outermost bracket portion 20 has a flange 40 extending horizontally for supporting the wire shelf 10. The innermost bracket portion 22 has a pivot hole 42 for pivotally supporting the innermost section of the wire shelf 10.

The shelf 10 is formed of wires as shown including a plurality of wires 44 which extend crosswise between the brackets and a plurality of wires 46 which extend parallel to the brackets. These wires are secured to one another by welding or brazing to form a rigid structure as is known in the art. As shown in FIG. 1 the wires may be formed to provide a shelf front 48 to prevent product on the shelf to prevent from falling forward. If desired there could also be shelf sides and a shelf rear wall.

Figure 2:
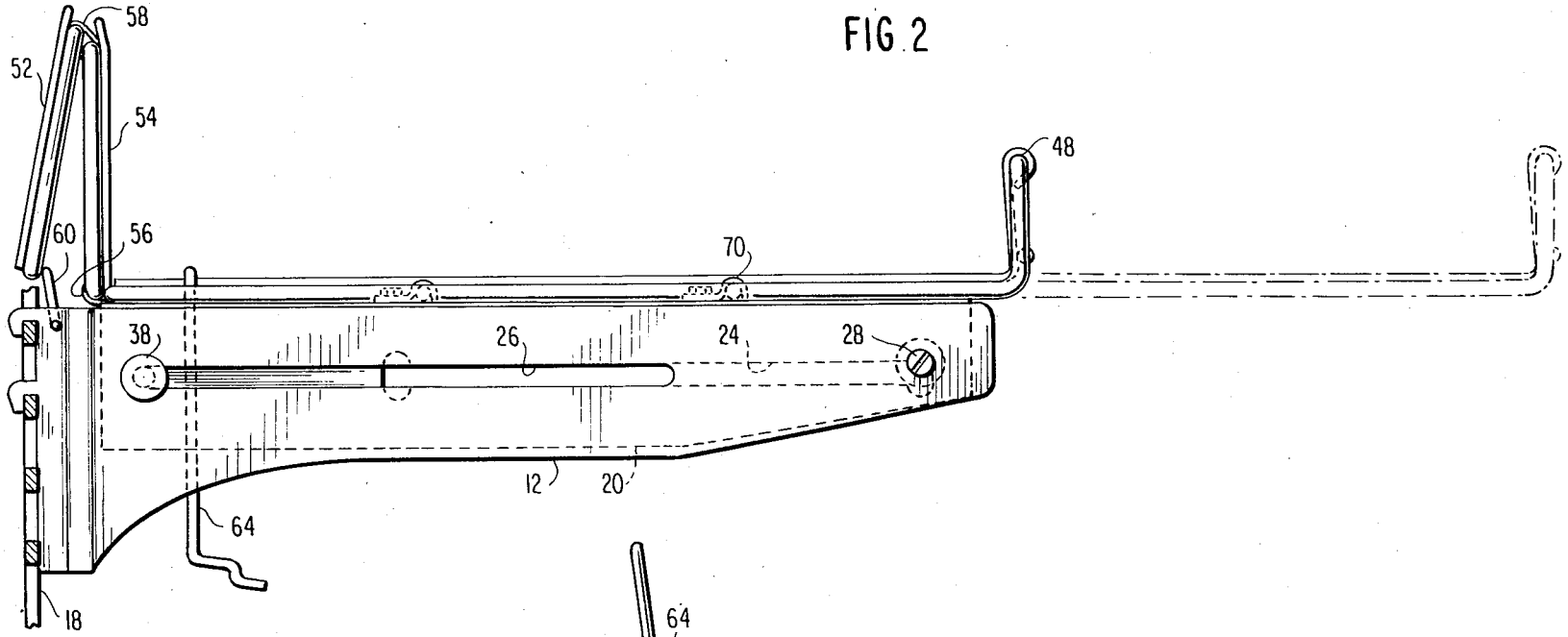
FIG. 2 is a side elevation view showing the shelf in retracted position.
Figure 3:
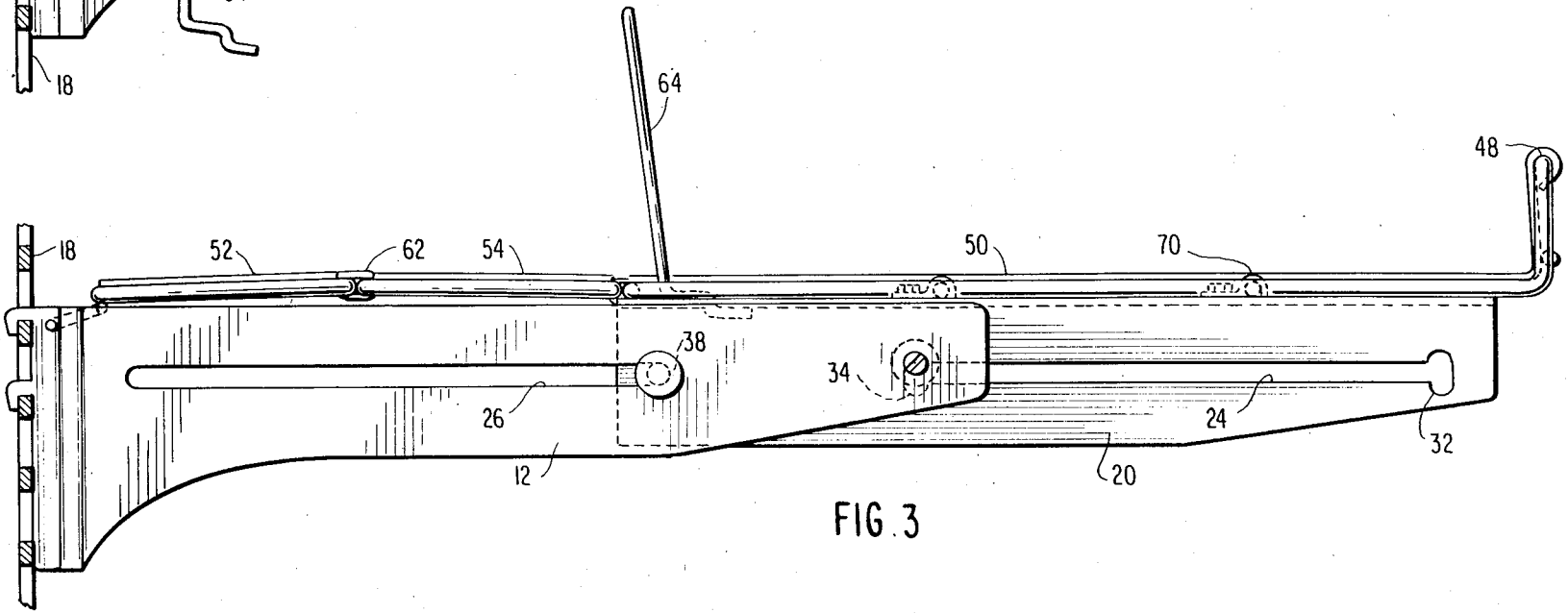
FIG. 3 is a side elevation view showing the shelf in extended position.

The shelf 10 is divided into three sections in the embodiment shown. There is a forward or outermost section 50, an innermost section 52, and an intermediate section 54. The wires of these sections are not welded to one another and the sections are hingedly connected to each other by suitable hinge means, in the case shown as loose collars 56 at spaced portions. These loose collars allow the sections 50, 52 and 54 to move relative to one another and particularly allow sections 52 and 54 to fold together as shown in FIG. 2 or to fold out flat as shown in FIG. 3. Sections 52 and 54 are also hingedly connected together by loose collars 58. The innermost end of section 52 has secured to it a bent wire 60 which is journalled in hole 42 of the bracket to pivot the innermost edge of section 52 from the inner bracket section 22. Attached to flange 40 by any convenient means such as clamps 70 are the sides of portion 50 of the wire shelf.

The wire sections 46 of sections 52 and 54 may have bent ends 62 in order to provide a stop for the pivotal movement at a point where the sections are almost, but not quite, in a plane with section 50. By having a very slight hump even when the shelf is pulled out as shown in FIG. 3 the innermost sections, 52 and 54, will be much easier to pivot.

There is also provided a stock contacting wire member 64 which has a section 66 extending across the shelf 10 from side to side. Member 64 may be movably attached to the rearward portion of the outermost bracket 20 by a hole in the flange 40.

The stock contacting member 64 is such that it can be pushed down through its mounting hole to lie flat if not used, or it can be removed entirely.

FIGS. 2 and 3 best illustrate the operation of the extendable shelf of this invention.

FIG. 3 shows the shelf in extended position with the bottom sections 50, 52 and 54 substantially flat. That is, in FIG. 3 sections 50, 52 and 54 are folded out flat rather than being folded up accordian style as in FIG. 2. The stock contacting member 64 is in its uppermost position. For use of the invention to provide a shelf with a smaller depth the outermost section 50 is merely pushed inwardly from the phantom line position shown in FIG. 2 to the full line position shown in FIG. 2. At this time the innermost section 52 pivots at both ends. Similarly, the intermediate section 54 pivots about collars 56 and 58 to assume the folded up position and also to provide a back for the smaller size shelf. A smaller size shelf might be used for example when the needs of store are such that a larger size shelf is not required. This eliminates inventory of two different size shelves. Another use would be a store which would need a larger shelf in one season and a smaller shelf in another season depending on the volume of traffic sold in the different seasons. This can be accomplished with a single shelf rather than changing inventory of the shelving of the display.

For restocking of the shelf, the shelf can be first moved to its smaller depth position as shown in FIG. 2, the stock contacting member can be pulled up behind all of the items on the shelf and then the shelf moved back out to the FIG. 3 position. This will cause all of the items to be brought forward by the stock contacting member 64 so that restocking can then take place behind member 64. As noted above member 64 can be dropped down out of the way.

The side brackets are narrow enough (being made of sheet metal) to enable extendable shelves of this invention to be assembled side by side on upright having two pairs of vertical holds as is common in the art. Also as will be understood by those with ordinary skill in the art the shelf can assume numerous sizes and shapes and need not be made exactly as disclosed herein while keeping with the spirit of the invention.

This invention has been executed in wire shelving which can be used as a 12 inch deep unit or a 19 inch deep unit and in various conventional widths such as 18 inches, 24 inches, 30 inches, 36 inches and 48 inches. Although not shown, a back rail may be provided for package support especially in the loading position and a side rail may be provided to prevent product from tipping over the side.

Conventional wire shelves 12 inches deep mounted on brackets can be converted to the present unit by the addition of the two rearmost telescoping sections and replacing the conventional brackets with the telescoping brackets of this invention. The unit is such that it can be set up with no tools, no shelf dividers are needed and no front edge molding is needed.

I claim:

1. An extendable shelf for a display rack, the shelf being of the type used on display racks having vertical support members for a pair of spaced apart side support brackets, and a spaced wire shelf bottom extending between the side support brackets, the brackets being connected to the vertical supports for attaching the shelf to form a part of a display rack, with improvements for making the shelf extendable from one depth to another and for allowing restocking of packages behind packages on the shelf at the time of restocking, the improvements comprising; each of the side bracket supports being in at least two sections, an outermost section and an innermost section, means telescopically mounting the side support bracket sections with regard to each other, the shelf bottom being formed of at least two movably related sections with the outermost section attached to the outermost section of the side support brackets and movable to decrease the depth of the shelf when the side support brackets are telescoped with respect to each other, and a package-contacting member extending above the plane of the shelf bottom and across the outermost shelf bottom section at the base portion thereof for contacting packages and moving the packages forwardly as the shelf is pulled out to move packages on the outermost shelf bottom section forward and to thereby allow restocking of fresh packages to the rear of the shelf behind the package-contacting member.

* * * * *